US010724836B1

(12) United States Patent
Hardt et al.

(10) Patent No.: US 10,724,836 B1
(45) Date of Patent: Jul. 28, 2020

(54) COOK-OFF MITIGATION SYSTEMS

(71) Applicant: The United States of America, as represented by the Secretary of the Navy, Arlington, VA (US)

(72) Inventors: Lee R. Hardt, Ridgecrest, CA (US); Donald L. Burnett, Spearfish, SD (US); Josiah S. Garfield, Ridgecrest, CA (US); Robert A. Koontz, Anchorage, AK (US); Eric K. Wooding, Ridgecrest, CA (US); Que T. BuiDang, Ridgecrest, CA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 131 days.

(21) Appl. No.: 16/113,786

(22) Filed: Aug. 27, 2018

Related U.S. Application Data

(63) Continuation-in-part of application No. 15/380,679, filed on Dec. 15, 2016, now Pat. No. 10,101,139.

(51) Int. Cl.

| | |
|---|---|
| ***F42B 12/20*** | (2006.01) |
| ***F42B 39/14*** | (2006.01) |
| ***F42B 39/20*** | (2006.01) |
| *F42C 19/02* | (2006.01) |
| *F41A 17/16* | (2006.01) |

(52) U.S. Cl.
CPC ..... *F42B 12/207* (2013.01); *F42B 12/20* (2013.01); *F42B 39/14* (2013.01); *F42B 39/20* (2013.01); *F41A 17/16* (2013.01); *F42C 19/02* (2013.01)

(58) Field of Classification Search
CPC ..... F42B 12/02; F42B 12/20; F42B 12/207; F42B 12/22; F42B 39/14; F42B 39/20; F41A 17/16; F42C 19/02
USPC ..... 102/473, 481
See application file for complete search history.

(56) References Cited

U.S. PATENT DOCUMENTS

| | | | | |
|---|---|---|---|---|
| 5,786,544 A * | 7/1998 | Gill | F42B 39/20 | 102/293 |
| 5,813,219 A * | 9/1998 | Gill | F42B 39/20 | 102/481 |
| 5,939,662 A * | 8/1999 | Bootes | F42B 12/06 | 102/473 |
| 6,523,477 B1 * | 2/2003 | Brooks | F42B 30/003 | 102/481 |
| 6,615,737 B2 * | 9/2003 | Bonnel | C06B 45/00 | 102/481 |
| 6,619,029 B2 * | 9/2003 | Solberg | F02K 9/38 | 102/381 |
| 6,752,085 B2 * | 6/2004 | Roach | F42B 39/14 | 102/481 |
| 7,353,755 B2 * | 4/2008 | Aumasson | F42B 39/20 | 102/481 |

(Continued)

*Primary Examiner* — James S Bergin
(74) *Attorney, Agent, or Firm* — Naval Air Warfare Center Weapons Division; James M. Saunders

(57) ABSTRACT

The disclosed embodiments are directed to enhancing insensitive munitions performance. Some of the embodiments employ an outgassing pad having unique geometrical configurations, compositions, and positioning. Other embodiments rely on using thermally-releasable components to foster billet expulsion. Additional embodiments combine both aspects into entire cook-off mitigation systems for insensitive munitions improvements.

4 Claims, 9 Drawing Sheets

(56) References Cited

U.S. PATENT DOCUMENTS

| | | | | |
|---|---|---|---|---|
| 7,472,653 | B1 * | 1/2009 | Hays | F42B 39/20 102/481 |
| 7,930,975 | B2 * | 4/2011 | Cotet | F42C 19/02 102/202.1 |
| 9,829,297 | B2 * | 11/2017 | Graswald | C06B 45/00 |
| 10,088,285 | B1 * | 10/2018 | Hardt | F42C 19/02 |
| 10,101,139 | B1 * | 10/2018 | Hardt | F42B 12/207 |
| 10,175,034 | B1 * | 1/2019 | Hardt | F42C 19/02 |
| 10,228,223 | B1 * | 3/2019 | Hardt | F42B 12/207 |
| 2006/0016360 | A1 * | 1/2006 | Eches | F42B 12/62 102/477 |
| 2006/0081149 | A1 * | 4/2006 | Salizzoni | F42B 12/08 102/477 |

* cited by examiner

COOK-OFF MITIGATION SYSTEMS

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD

The embodiments generally relate to insensitive munitions.

Figure 1:
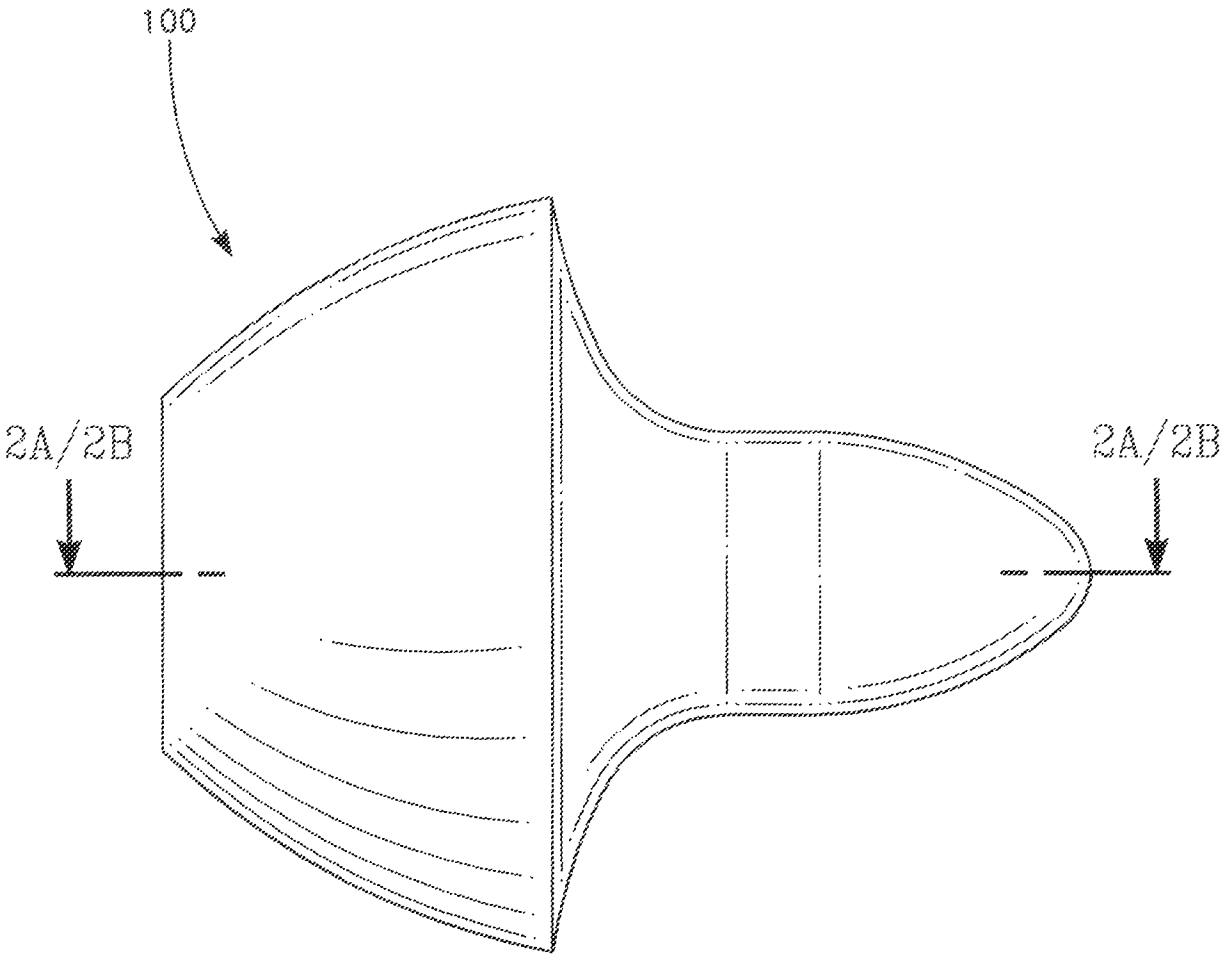
FIG. 1 is a side view of an outgassing pad, according to some embodiments.

It is to be understood that the foregoing general description and the following detailed description are exemplary and explanatory only and are not to be viewed as being restrictive of the embodiments, as claimed. Further advantages of the embodiments will be apparent after a review of the following detailed description of the disclosed embodiments, which are illustrated schematically in the accompanying drawings and claims.

DETAILED DESCRIPTION OF EMBODIMENTS

Embodiments may be understood more readily by reference in the following detailed description taking in connection with the accompanying figures and examples. It is understood that embodiments are not limited to the specific devices, methods, conditions or parameters described and/or shown herein, and that the terminology used herein is for the purpose of describing particular embodiments by way of example only and is not intended to be limiting of the claimed embodiments. Also, as used in the specification and appended claims, the singular forms "a," "an," and "the" include the plural.

Embodiments generally relate to insensitive munitions (IM) improvements, especially with respect to cook-off mitigation systems. Some embodiments employ an outgassing pad in the nose of the munition. Additional embodiments employ a releasable (two-part) charging well. Further embodiments combine these approaches with a releasable tail closure mechanism.

Although the embodiments are described in considerable detail, including references to certain versions thereof, other versions are possible. Examples of other versions include orienting and/or attaching components in different fashion. Therefore, the spirit and scope of the appended claims should not be limited to the description of versions included herein.

Components and Materials Used

In the accompanying drawings, like reference numbers indicate like elements.

Reference characters 100, 400, and 500 are used to depict various embodiments. Several views are presented to depict some, though not all, of the possible orientations of the embodiments. Some figures depict section views and, in some instances, partial section views for ease of viewing. The patterning of the section hatching is for illustrative purposes only to aid in viewing and should not be construed as being limiting or directed to a particular material or materials. Unless stated otherwise, components depicted are dimensioned to be close-fitting and to maintain structural integrity both during storage and while in use.

Components used in several embodiments, along with their respective reference characters, are depicted in the drawings. Reference character 100 depicts an outgassing pad. In some embodiments, the outgassing pad 100 includes a shell 102 and an outgassing agent 104, such as a powder and binder mix. The shell 102 can be an elastomeric shell such as silicone, rubber, or silicone-rubber. The outgassing agent 104 is a powder and binder mix. The elastomeric shell 102, may also be referred to as an outgassing shell, container, or bladder, and can be used to house the outgassing agent 104 as a technique for controlled fragmentation, enhanced gas containment, and as a reduction in compatibility concerns. A person having ordinary skill in the art will recognize the term compatibility concerns to be synonymous with assuring that chemicals coming in contact with an explosive fill are chemically compatible.

In other embodiments, the shell 102 can be a non-elastomeric shell such as plastic. In yet other embodiments, the shell 102 can be eliminated. In embodiments without a shell 102, the outgassing pad 100 is the outgassing agent 104, as discussed further below. The surface contours of the outgassing pad (reference character 100) with a shell (reference character 102) as well as the outgassing pad without the shell are the same. Section views best illustrate the outgassing pad 100 embodiments. Generically, the outgassing pad is depicted with reference character 100. Reference character 100A depicts the section view of an outgassing pad with a shell, as shown in FIG. 2A. The embodiment in FIG. 2A can also be referred to as a confined or canistered outgassing pad 100A. Conversely, as shown in FIG. 2B, reference character 100B depicts the section view of an outgassing pad without a shell, and can be referred to as an unconfined or uncanistered outgassing pad.

The shell 102 has unique geometrical configurations, including surface contours having a sigmoid shape, ogee shape, or a cyma recta shape. A person having ordinary skill in the art will recognize that ogee and cyma recta are understood to be types of sigmoid shapes. A person having ordinary skill in the art will recognize that a sigmoid shape is a shape similar to the letter S. Likewise, a person having ordinary skill in the art will recognize that an ogee shape is descriptive of an S-shape and, moreover, is characteristic of two curves meeting at a point. Additionally, a person having ordinary skill in the art will recognize that a cyma recta shape is descriptive of double curvature, combining both convex and concave features. A person having ordinary skill in the art will also recognize, after viewing FIG. 2A, that the shell 102 can have a first portion 210A that is characteristic of a rounded trapezoid, truncated ogive or truncated ogival shape, and a second portion 212A that is sigmoid-shaped, ogee-shaped, or cyma recta-shaped. Likewise, the first portion 210A can also have a meplat shape. A person having ordinary skill in the art will recognize that the word meplat is used in ballistics and is a technical twit for a flat or open tip on the nose of a bullet. The selected shapes are based on reducing stress concentration during obturation and also shock wave focusing during target penetration.

Figure 2B:
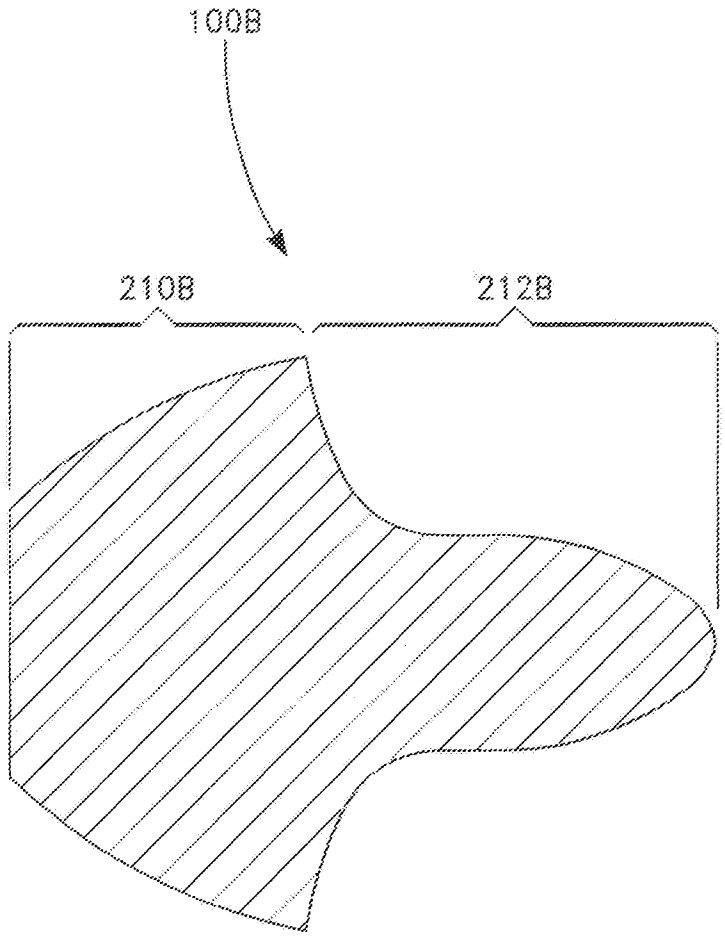
FIG. 2B is a section view of an outgassing pad without a shell, according to some embodiments.
Figure 2A:
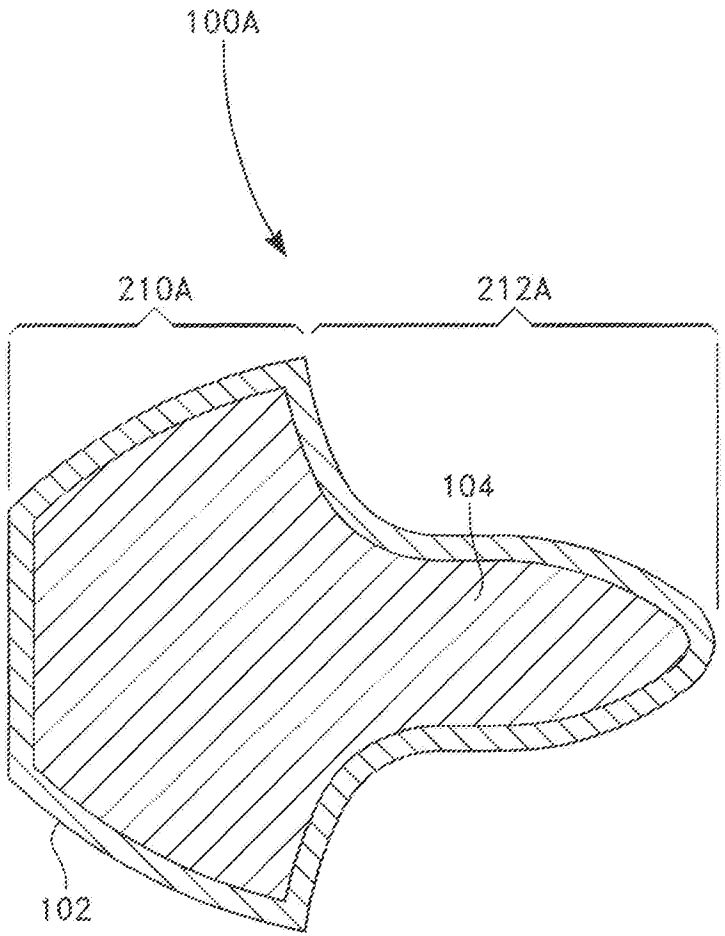
FIG. 2A is a section view of an outgassing pad with a shell, according to some embodiments.

Likewise, the surface contour shapes are also applicable to the embodiment depicted in FIG. 2B by reference characters 100B, 210B, and 212B. Specifically, the outgassing pad without the shell (reference character 100B) can also have a first portion 210B that is characteristic of a rounded trapezoid, or meplat, truncated ogive, or truncated ogival-shape, and a second portion 212B that is sigmoid-shaped, ogee-shaped, or cyma recta-shaped. The selected shapes are based on reducing stress concentration during obturation and also shock wave focusing during target penetration.

Selection of the outgassing agent 104 is based on several factors including volume-to-mass ratio of decomposition products, activation temperature, compatibility and stability, cost, material availability, and environmental concerns. The outgassing agent 104 is a powder-binder mix. Suitable powders for the outgassing agent 104 include a blowing agent mixed with an activator. Suitable blowing agents include oxydibenzenesulfonyl hydrazide (OBSH) or azodicarbonamide (ADC), due to their cell structures. The blowing agent is mixed with the activator to tune the decomposition temperature and rate. In the embodiments, zinc oxide is a suitable activator. Depending on application-specific requirements, other activators can also be used. Additionally, in other embodiments, an activator may not be needed depending on the blowing agent selected or other system requirements. Suitable binders for the outgassing agent 104 include wax, tar, or an energetic binder. Binder formation includes melt cast methods for waxes, cast-curing from a mold, and press-molding for the powder-binder mixes.

In the unconfined embodiment (100B in FIG. 2B), the outgassing pad 100 is an outgassing agent 104 held in a specific geometry by incorporating a binder. Thus, in some embodiments, the elastomeric shell 102 can be eliminated by mixing the outgassing agent's 104 powder (such as azodicarbonamide and zinc oxide) and an activator such as zinc oxide with a binding agent such as, for example, asphaltic hot mix or Epolene wax. The mixture allows for the application of the outgassing agent (and hence the outgassing pad 100B) and binder to be applied directly to the wall of the munition 502 as a liner.

The powders in the outgassing agents 104 will compact appreciably during target penetration, which is undesirable. Adding the binder to create a powder-binder mix eliminates this concern because the binder fills the void spaces between the particles of the powder which constitutes the powder, thus reducing the compaction. The mixture of the powder-binder is determined based on application-specific conditions. In some embodiments, the powder (azodicarbonamide and zinc oxide) is a range of about 66 to about 68 percent and the binder is 30 percent. The variation in constituents is from varying percentages of additive(s) used to tune the peak exothermal temperature.

Instances having different ranges are also possible and can be dependent on the processing of the material such as particle size, particle geometry, packing fraction, and wettability. Additionally, the cost of manufacturing/processing the material can drive one process over another which can correspondingly change the requisite ranges. Based on this, in other embodiments, the range is about 60 percent to about 70 percent powder, and a binder range of about 30 to about 40 percent, with the remaining constituents being additive(s) used to tune the peak exothermal temperature. Likewise, when tuning the powder-binder mix to expel a munition's explosive billet, the unique characteristics of that specific munition can drive the percentages. As such, a larger/different range can be beneficial in addressing the maintaining of the mass properties of a munition system by adjusting the powder-binder mixture to closely match the density of the munition's main explosive billet, thus avoiding changes to flight or performance characteristics.

Reference character 400 depicts a charging well that is housed entirely in the munition casing 504, with no portion inside the explosive fill. The charging well 400 employs a charging well component 408, fasteners 414, a cutting device 415, sometimes referred to as a cutter, knife blade or other variation, and a eutectic charging tube extension 413. The charging well component 408 is generically depicted because the embodiments are applicable to a variety of charging well components without detracting from the merits or generalities of the embodiments. The charging well component 408 is contoured to match the munition case 504 interior contours, defined by a cavity 402 in the munition case 504. Additionally, a person having ordinary skill in the art will recognize the specific components used in charging wells. The charging well component 408 is a structural material and, in most embodiments, is steel. A protective liner 411 is shown in some embodiments. Suitable liner materials include asphaltic hot melt, wax coating, and plastic.

Figure 5:
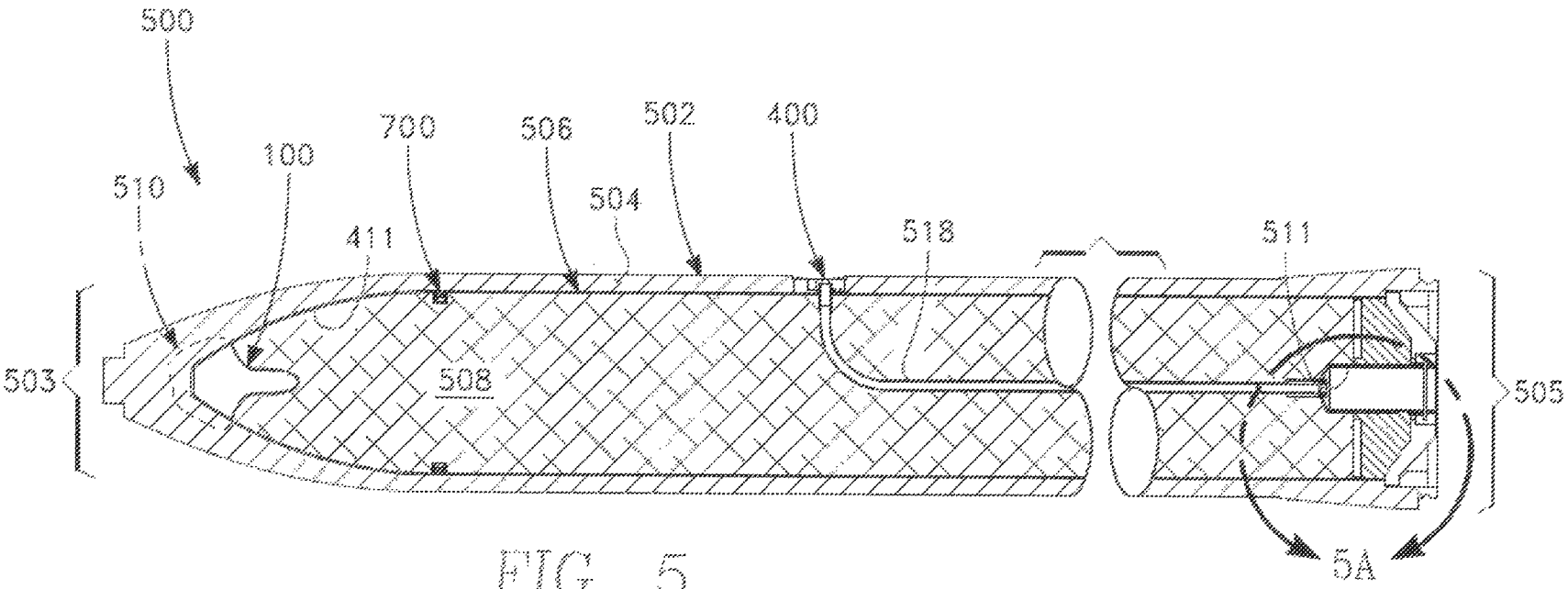
FIG. 5 is a partial section view of a cook-off mitigation system in a generic munition, according to some.

FIG. 5 depicts a cook-off mitigation system 500 in a generic munition 502. In addition to the outgassing pad 100 and charging well 400, the system 500 includes a munition casing 504 with an interior wall 506 defining at least one interior compartment configured to house an explosive fill 508. The interior wall 506 is the interior surface of the munition casing 504. As such, reference character 506 is used herein for both the interior wall and the interior compartment since the interior wall defines the interior compartment. At times the explosive fill 508 is referred to as an explosive billet or simply as an explosive without detracting from the merits or generalities of the embodiments. Steel conduit 518, sometimes referred to as a charging tube, can be used to house cable (not shown for ease of view) transmitting power and/or signals between the charging well 400 and a steel fuze well 511. References to the use of steel herein also include steel alloys. A releasable tail closure mechanism 512 employs a base plug 514 and releasable base plate 516.

Additional components are shown for orientation purposes and to assist in understanding operating environments. In particular, FIG. 5 is very useful for illustrating an operating environment for several of the features employed in the embodiments. A synthetic felt pad 520 is generically shown and can be used in some munitions to provide ullage space, but is not needed in all munitions. Sealant 522 is also generically shown, and is used to prevent slumping of the explosive billet 508 during curing in some, but not all munitions. A steel fuze well retaining ring 524 assists in securing the fuze well 511 to the munition casing 504.

Eutectic devices, such as eutectic retaining nuts and plates, are used and are discussed in greater detail below.

Apparatus and System Embodiments

Figure 3A:
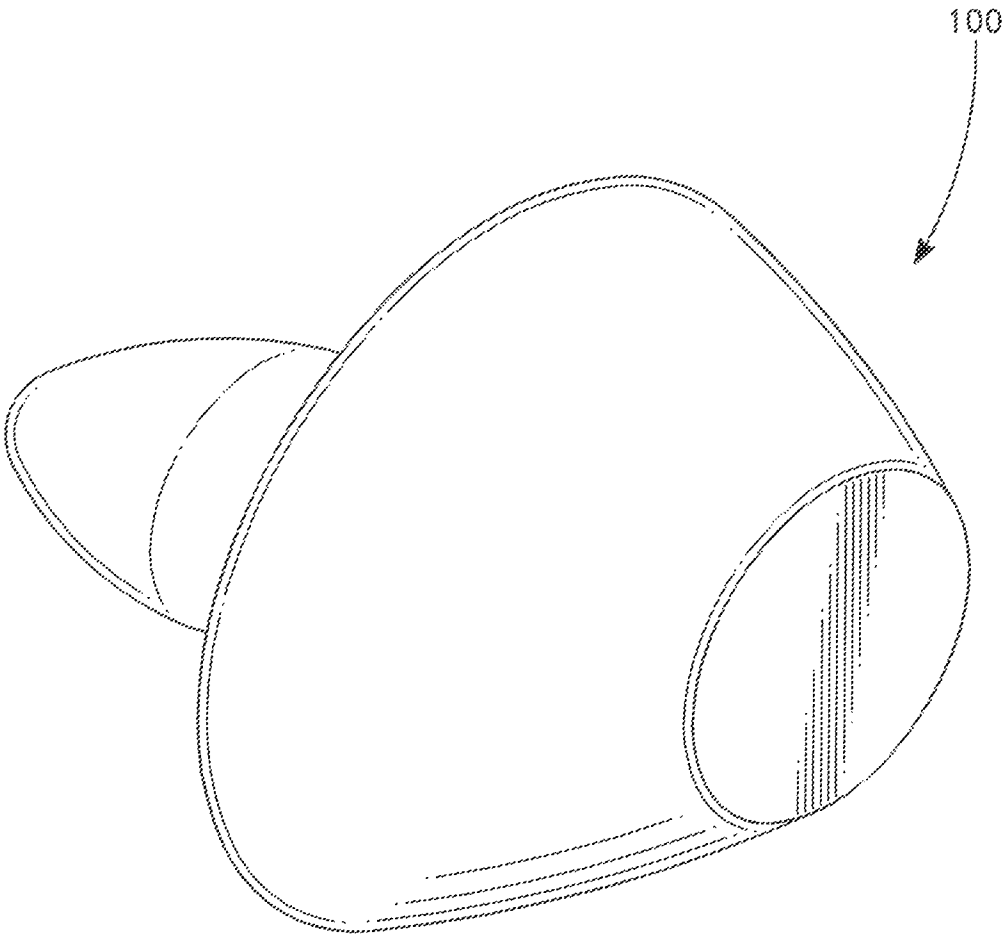
FIG. 3A is a nose end perspective view of the outgassing pad in FIG. 1, according to some embodiments.
Figure 3B:
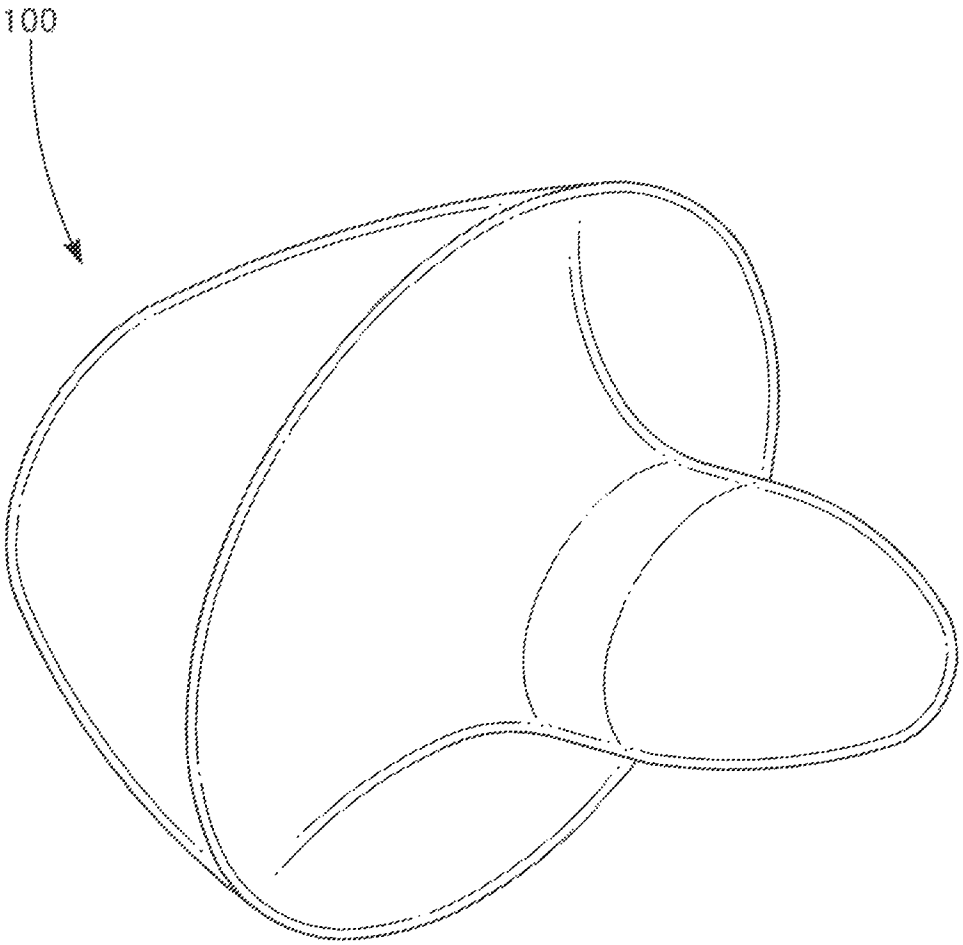
FIG. 3B is a tail end perspective view of the outgassing pad in FIG. 1, according to some embodiments.

An outgassing pad for cook-off mitigation is depicted by reference character 100 in FIGS. 1, 3A, 3B, & 5. The outgassing pad for cook-off mitigation 100 is sometimes referred to simply as an outgassing pad, pad, and the like, without detracting from the merits or generalities of the embodiments. FIG. 1 is a side view of the outgassing pad 100. FIG. 1 is generic with respect to its application of an outgassing pad with a shell and an outgassing pad without a shell and, thus, is generically depicted using reference character 100. Specific section views of an outgassing pad with a shell and an outgassing pad without a shell are depicted by reference characters 100A & 100B in FIGS. 1A & 2B, respectively. As such, FIG. 2A is the section view of the outgassing pad with shell along cut plane 2A-2A in FIG. 1. FIG. 2B is the section view of an outgassing pad without a shell along cut plane 2B-2B in FIG. 1. FIGS. 3A & 3B show the outgassing pad 100 from nose end and tail end perspective views, respectively.

Figure 4:
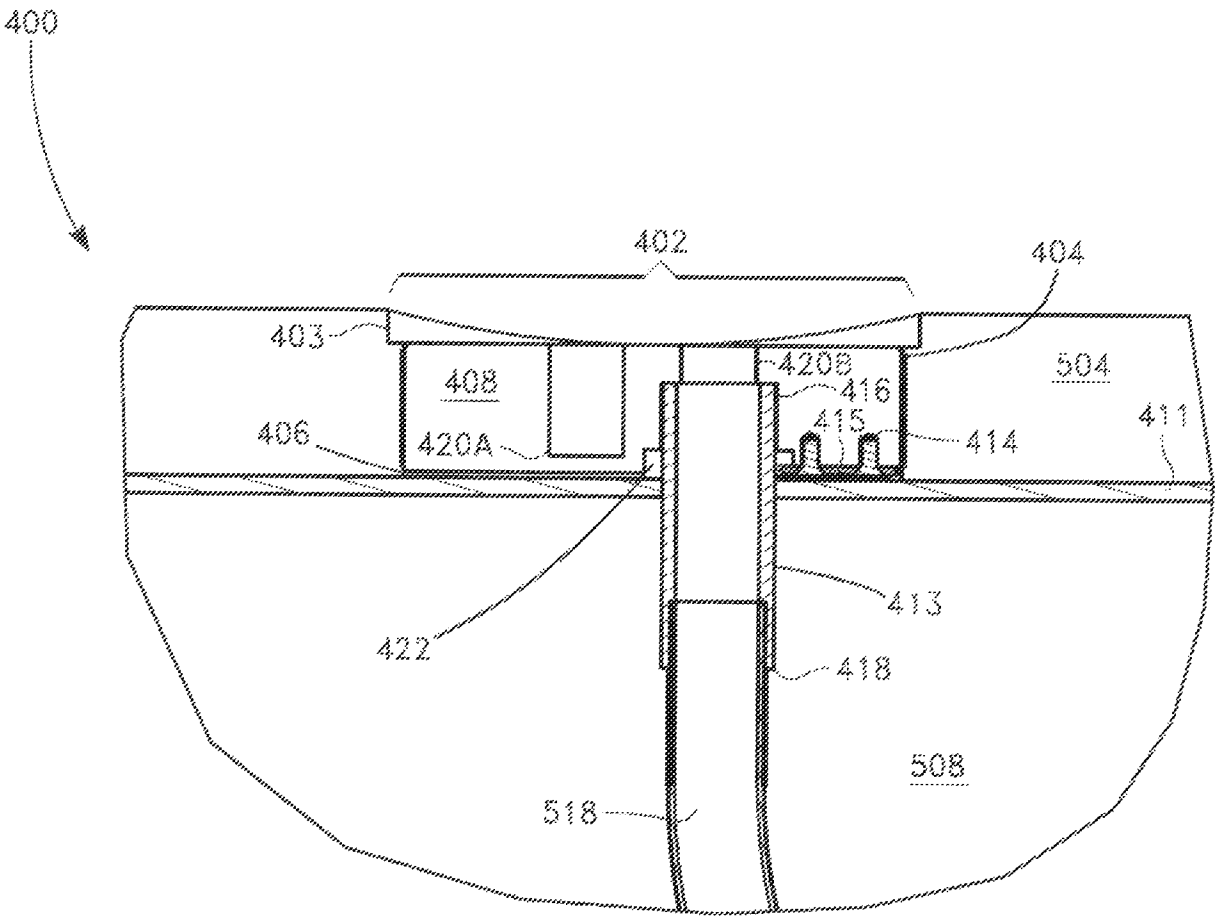
FIG. 4 a close-up of a partial section view of a charging well, according to some embodiments.
Figure 6:
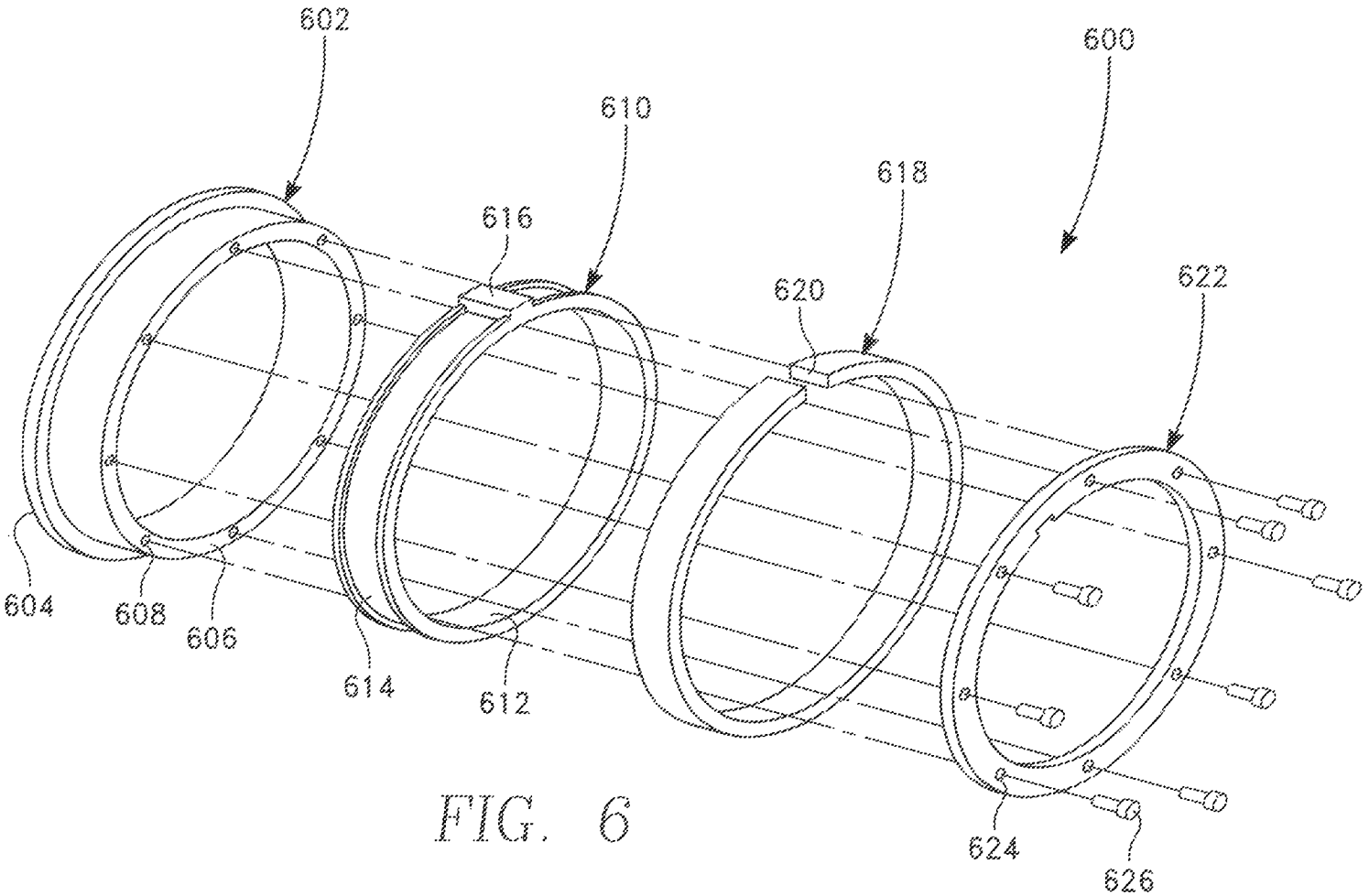
FIG. 6 is an exemplary exploded view of a eutectic device that can be used in some embodiments.
Figure 7:
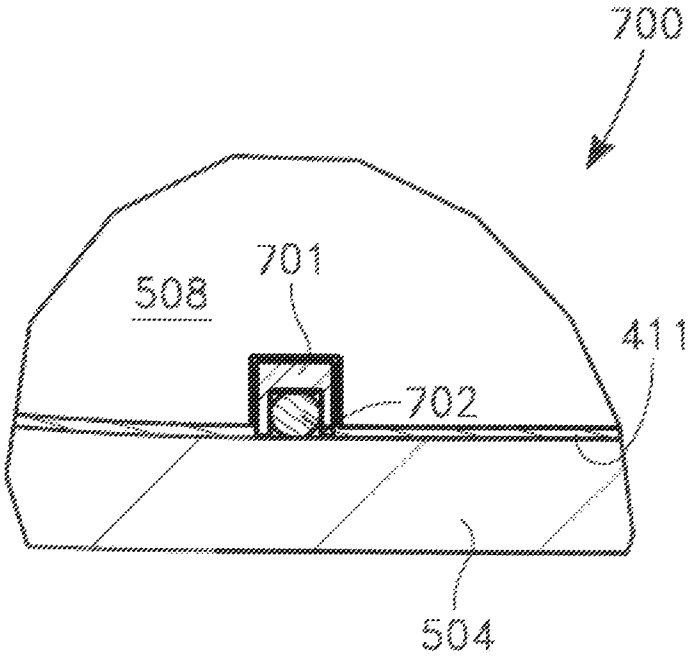
FIG. 7 is a close-up partial section view of a gas sealing device shown in its operating environment.
Figure 8:
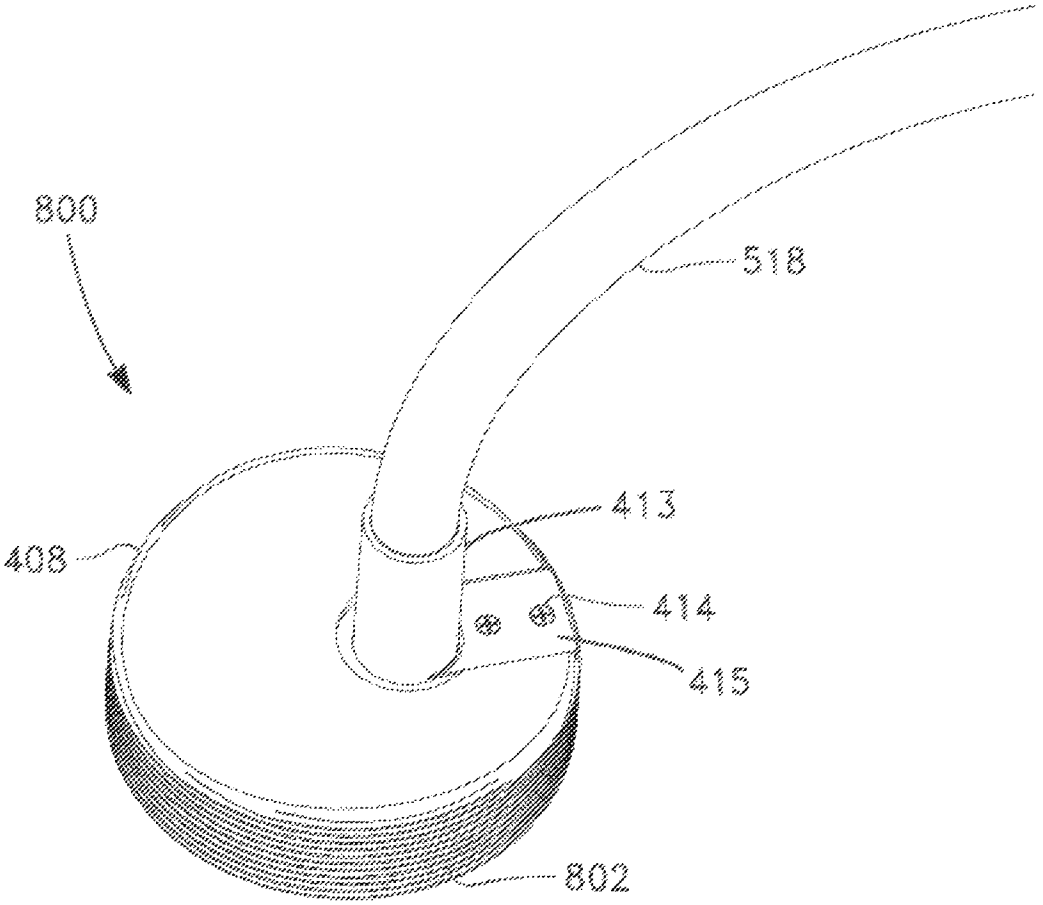
FIG. 8 is an inverted isometric view of some components in the charging well from FIG. 4.

FIG. 4 is a close-up partial section view of a charging well for cook-off mitigation, as depicted by reference character 400. FIG. 8 is an inverted isometric view of some components and their associated structural features in the charging well 400. The charging well for cook-off mitigation 400 is sometimes referred to simply as a charging well and other similar variations, without detracting from the merits or generalities of the embodiments. FIG. 5 illustrates a cook-off mitigation system 500 in a generic munition 502. FIG. 6 is an exploded view of a eutectic device 600 that can be used in some embodiments. FIG. 7 is an exploded view of a gas sealing system 700 that may be used in some embodiments.

Referring to FIG. 2A, the outgassing pad with a shell (reference characters 100A and 102) houses an outgassing agent 104. Referring to FIGS. 1 & 5, a generic munition is depicted with reference character 502 having a munition casing 504 with an interior wall 506. The munition 502 has a nose end 503 and a tail end 505. The interior wall 506 defines an interior compartment that is configured to house an explosive fill 508. The outgassing pad 100 is positioned inside the interior compartment 506 and adjacent to the interior nose end 510 of the munition 502.

Outgassing pad 100 positioning and, therefore, the shell 102, such as in the embodiment depicted in FIG. 2A by reference character 100A, is notable because previous attempts at using an outgassing pad were, if employed at all, positioned in an aft vent and not in the nose end. Similarly, the embodiment depicted in FIG. 2B by reference character 100B is also notable for the same reason. Furthermore, previous attempts at using outgassing pads, if used at all, were flat, circular discs and not shaped as disclosed herein.

The shell 102 has at least two sides 210A & 212A, synonymous with the first and second portions mentioned above, that are diametrically-opposed to each other with one of the two sides being adjacent to the interior nose end 510 of the munition 502. Viewing FIGS. 2A & 5 simultaneously, it is readily apparent that the side depicted by reference character 210A is adjacent to the interior nose end 510 of the munition 502. The other side, depicted by reference character 212A, is adjacent to the explosive fill 508 housed in the interior compartment 506 of the munition 502. The explosive fill 508 holds the shell 102 adjacent to the interior nose end 510. Adhesive can be used, if desired, to adhere the shell 102 adjacent to the interior nose end 510.

Similarly, the outgassing pad without a shell (reference character 100B in FIG. 2B) also has at least two sides 210B & 212B, synonymous with the first and second portions mentioned above, that are diametrically-opposed to each another with one of the two sides being adjacent to the interior nose end 510 of the munition 502. Viewing FIGS. 2B & 5 simultaneously, it is readily apparent that the side depicted by reference character 210B is adjacent to the interior nose end 510 of the munition 502. The other side, depicted by reference character 212B, is adjacent to the explosive fill 508 housed in the interior compartment 506 of the munition 502. The explosive fill 508 holds the outgassing pad without a shell (reference character 100B) adjacent to the interior nose end 510. Adhesive can be used, if desired, to adhere the outgassing pad without a shell (reference character 100B) adjacent to the interior nose end 510. Additionally, the outgassing pad without a shell (reference character 100B) can be adhered to the interior wall 506 of the munition by selecting a binding agent such as, for example, asphaltic hot mix or Epolene wax, which allows for the application of the outgassing agent and binder to be applied directly to the interior wall of the munition 502 as a liner.

Referring to FIG. 4, the components in the charging well 400 are shown assembled. The charging well 400 includes a charging well cavity 402 that is a void that penetrates the munition casing 504. The charging well cavity 402 has a proximal end 404, a distal end 406, and threaded surface, sometimes referred to as a threaded interior surface (not shown for ease of viewing). A counterbore 403, sometimes referred to as a spot face, transitions to the proximal end 404 of the cavity 402 and is configured as shown to create a smooth, flat surface to assist with mating.

Referring to both FIGS. 4 & 8, the charging well component 408 has a threaded exterior surface 802. The charging well component 408 is attached inside the charging well cavity 402 by threading engagement of the charging well component's threaded exterior surface 802 to the threaded interior surface of the charging well cavity. Stated another way, the threaded exterior surface 802 can be referred to as mating threads that attach the charging well component 408 to the munition casing 504, i.e. inside the charging well cavity 402. Both the charging well cavity 402 and charging well component 408 have appropriate thread relief features.

Referring to FIGS. 4 & 5, the munition casing 504 has a nose end 503 and a tail end 505. The charging well component 408 is electrically connected, sometimes referred to as in electrical communication with, a munition fuze 513 via the conduit 518, which can be referred to as a communication conduit and/or power cable conduit. The munition fuze 513 is housed in a fuze well 511 at the tail end 505. A eutectic charge tube extension 413 has a first end 416 and a second end 418. The first end 416 of the eutectic charge tube extension 413 is configured for mating engagement with the charging well component 408. The second end 418 is configured for mating engagement with the communication conduit 518 (the opposing end of the communication conduit—opposite from the end connected to the fuze well 511/fuze 513.

An explosive fill 508 is generically shown in FIG. 5 and is housed in the munition casing 504. The munition casing 504 is steel and has an interior protective liner 411 separating the munition casing and the charging well 400 and, hence, the charging well cavity 402 and charging well component 408 from the explosive fill 508.

The cutter/cutting device 415 is positioned adjacent to the eutectic charge tube extension 413 and is attached to the charging well component 408 by fasteners 414. Other attachment methods can be used including adhesives. The eutectic melt temperature of the eutectic charging tube extension 413 is less than the outgassing temperature of the outgassing agent. The cutter/cutting device 415 is held in a fixed position and is configured to cut the cable(s) inside the conduit 518 and eutectic charge tube extension 413 after the eutectic charge tube extension has melted during a cook-off event. This prevents the cable(s), conduit 518, and any portion of the eutectic charging tube extension 413 remaining to move toward the tail end 505.

Void spaces 420A & 420B are shown in FIG. 4. The void spaces 420A & 420B are shown for attachment with communication plugs (not shown for ease of viewing) to transfer power or information via the void spaces through the eutectic charging tube extension 413, communication conduit 518, and finally to the munition fuze 513. Thus, the charging well component 408 is a communication interface between communication plug(s) and the fuze 513. A cutter device void space 422 exposes the cutting device 415 internally in the charging well component 408 for efficient cutting.

Figure 5A:
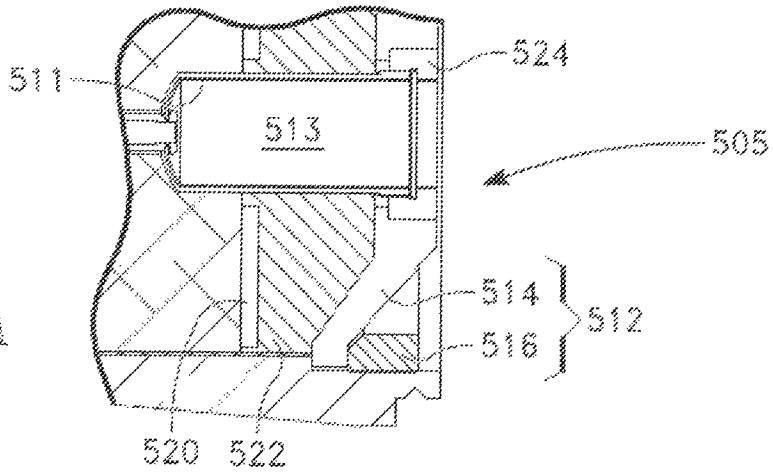
FIG. 5A is a partial cutaway section view of the tail end of the system in FIG. 5, according to some embodiments.

FIGS. 5 & 5A depict another embodiment. A cook-off mitigation system 500 in a generic munition 502 is shown. In particular, the system 500 includes the outgassing pad 100, the charging well 400 and associated components discussed previously. The charging well 400 and associated components are electrically-connected to the fuze well 511 to provide power to a munition fuze 513 that is housed in the fuze well, and shown generically for ease of viewing. As depicted in FIG. 5, the charging well 400 is located (positioned) at about the midpoint (middle) of the munition 502, which is about half way between the nose end 503 and tail end 505. As discussed above, mating threads attach the charging well 400 and associated components to the munition casing 504. A releasable tail closure mechanism 512 (depicted in FIG. 5A) is attached to the tail end 505 of the munition casing 504 and is configured to house an explosive fill 508 in the interior compartment 506.

FIG. 5A is a partial cutaway section view of the tail end 505 of the system 500 in FIG. 5. The releasable tail closure mechanism 512 has a base plug 514 that is concentric about the fuze well 511 and is attached to the munition casing 504. The base plug 514 is steel or steel alloy. A thermally-releasable base plate 516 is concentric about the fuze well 511 and fits on the outer periphery of the base plug 514 and is attached to the base plug and the munition casing 504. As shown in FIG. 5A, the releasable tail closure mechanism 512 includes both the base plug 514 and the thermally-releasable base plate 516. In some embodiments, the thermally-releasable base plate 516 is a eutectic device. However, the method the base plate 516 uses to release does not have to be only eutectic as long as it releases prior to the outgassing of the material. Thus, alternative materials include a shape memory alloy or a polymeric material. Components depicted are dimensioned to be close-fitting and to maintain structural integrity both during storage and while in use.

FIG. 6 illustrates a eutectic device, generically depicted with reference character 600, which can be used in some embodiments, including the thermally-releasable base plate 516 shown in FIG. 5A. The eutectic feature in FIG. 6 is based on U.S. Air Force venting configurations. The eutectic device 600 is shown in an exploded view and is representative of the eutectic device 516 shown in FIG. 5A, respectively. The eutectic device 600 includes a hub ring 602 having a proximal side 604 and a distal side 606. The distal side 606 has a plurality of threaded recesses 608. Suitable materials for the hub ring 602 include steel and steel alloys. A eutectic ring 610 has an inner surface 612, an outer surface 614, and a rib 616 on its outer surface. The inner surface 612 of the eutectic ring 610 is concentric about the hub ring 602. Suitable materials for the eutectic ring 610 include metal alloys having about 58 percent bismuth (Bi) and about 42 percent tin (Sn). The eutectic ring 610 composition is tuned to a desired aft closure release temperature. Adjusting the percentages may change the melt temperature, which may allow for tuning of the desired release. Thus, in some embodiments, the bismuth (Bi) composition may be about 50 to 60 percent and the tin (Sn) composition is about 40 to 50 percent, depending on the desired release temperature.

A spring ring 618 is concentric about the eutectic ring 610. The spring ring 618 has a slot 620 that is dimensioned to engage the rib 616 on the eutectic ring 610. Suitable materials for the spring ring 618 include steel and spring back steel. The rib 616 and slot 620 engagement prevents axial movement of the spring ring 618 about the eutectic ring 610. A retainer ring 622 has a plurality of apertures 624 that are thru-holes in the retainer ring. Suitable materials for the retainer ring 622 include steel. When assembled, the retainer ring 622 is abutted against the hub ring 602, the eutectic ring 610, and the spring ring 618. A plurality of screws 626 fasten the retainer ring 622, the spring ring 618, the eutectic ring 610, and the hub ring 602 together by being inserted through the plurality of apertures 624, through the retainer ring 622, and into the plurality of threaded recesses 608 on the distal side 606 of the hub ring 602. The screws 626 can be steel or steel alloy cap screws.

FIG. 7 depicts a gas sealing device 700, sometimes referred to as a sealing device or mechanism. The sealing device 700 is co-extensive with a portion of the protective liner 411. The sealing device 700 has a steel O-ring holder 701 configured to hold an O-ring 702. Rubber is an appropriate material. More accurately, a high temperature rubber material is selected, such as silicone or a fluoropolymer elastomer rubber. The O-ring holder 702 may be positioned at the forward end of the full internal diameter of the munition casing 504.

Theory of Operation

Outgassing pad 100 positioning in the interior nose end 510 in conjunction with the defined geometry, described herein, aids in containing decomposition products to more effectively control the expulsion of explosive billet 508 out of the munition 502 after the release of the tail closure mechanism 512 and charging tube extension 413. Less outgassing agent 104 can be used and provides for a more focused outgassing environment. Outgassing agent 104 quantity can change due to the quantity of gases needed to expel the explosive billet 508. Positioning the outgassing pad 100 in the nose end 503 of the munition 502 reduces the risk of shock initiation of the explosive fill 508 in hard target penetration munitions.

The outgassing pad 100 location, geometry, and outgassing agent 104 selection is based on the anticipated gaseous products and reaction temperature for a specific munition. Employing an elastomeric shell 102 allows contained expansion and uniform pressure upon the explosive billet 508 until the elastomeric shell ruptures. Decomposition of the outgassing agent 104 occurs prior to reaction of the explosive fill (at a temperature range of about 280 degrees F. to about 320 degrees F. for some explosive fills and about 280 degrees F. to 350 degrees F. for other explosive fills).

The selected shape of the outgassing pad 100 is such that it expands as a wedge and obturates the explosive fill 508. One having ordinary skill in the art will recognize that obturate is a term for sealing by expanding. Thus, the outgassing pad 100 expands as a wedge and further expands the portion of the explosive billet 508 at the interior nose end 510 against the interior wall 506, further sealing the expanding gas at rupture. Silicone is used for the elastomeric shell 102 to allow for contained expansion at elevated temperatures and uniform pressure upon the explosive billet 508 until the elastomeric shell ruptures.

To avoid possible detrimental fragmentation effects to the nose end 503 of the munition 502, the outgassing pad 100 and, especially the elastomeric shell 102, can also contain fragmentation control patterns to contour the explosive charge and influence preferential fragmentation. With the internal pressure created by the outgassing agent 104, the explosive billet 508 can be expelled from the munition 502 using the releasable tail closure mechanism 512 prior to ignition of the explosive billet. Thermal release of the eutectic devices occurs at a range of about 280 degrees F. to about 320 degrees F. This allows the explosive billet 508 to burn totally unconfined, thus producing a passing reaction by reducing the severity of the munition reaction to standardized IM cook-off testing, often referred to as slow cook-off (SCO) and fast cook-off (FCO). The cook-off temperatures are greater than the munition's operational temperatures. One skilled in the art will recognize that insensitive munitions testing includes identifying the system's response to standardized testing. Munitions responses are assessed depending on multiple variables and an acceptable reaction, sometimes referred to as a passing reaction or passing test.

The charging well 400 is configured to remain functional at operational temperatures but weaken at cook-off temperatures, allowing for the unimpeded expulsion of the explosive billet 508. The eutectic charge tube extension 413 is a eutectic material, that maintains structural integrity of the eutectic charge tube extension during operation through munition 502 impact, but will soften and/or melt before the outgassing pad 100 outgasses. The eutectic charge tube extension 413 in one embodiment is bismuth, tin, and indium. In other embodiments, the charge tube extension 413 does not have to be eutectic provided that it softens at a high temperature, such as a polymer. The cutting device 415 will cut the eutectic charge tube extension 413 (if needed) and cables (not shown) in the conduit 518 as the explosive billet 508 is pushed toward the tail end 505 of the munition case 504 when the outgassing pad 100 outgases. Additionally, the entire charging well cavity 402 and component 408 is outside of the explosive billet 508, as shown in FIG. 4. Thus, lateral movement of the explosive billet is not to be limited by the charging well 400, communication conduit 518, or eutectic charging tube extension 413. Once the eutectic charge tube extension 413 is thermally released or severed, the conduit 518 is concurrently released, while the explosive billet 508 is moving laterally from the nose end 503 through the tail end 505, as the thermally-releasable base plate 516 releases.

In an embodiment employing an unconfined/uncanistered outgassing pad 100B, as depicted in FIG. 2B, the outgassing pad is in direct contact with the explosive billet 508. The outgassing pad 100B is selected to be chemically compatible with the explosive billet 508. As with the embodiment employing a shell 102, the unconfined/uncanistered outgassing pad 1008 generates gas. The generated gas is applied to the explosive billet 508 and the release process described above occurs and the explosive billet is expelled.

The sealing device 700 can be used to reduce leakage of gas and to push the explosive billet 508. A steel ring holder 701 with O-Ring 702 pushed all the way to the forward transition between the full inside diameter and ogive of the munition case 504 before the protective liner 411 is applied. The location of the sealing device 700 is at the transition of the interior wall 506 from being straight (having a constant internal diameter) to the portion of the interior wall having a tapered internal diameter due to the ogive shape of the munition 502. The sealing device 700 is as an extra safety measure in case the outgassing pad 100 does not expand as a wedge. In those instances, the sealing device 700 will obturate and influence the explosive billet 508 to move to the tail end 505 during cookoff events.

While the embodiments have been described, disclosed, illustrated and shown in various terms of certain embodiments or modifications which it has presumed in practice, the scope of the embodiments is not intended to be, nor should it be deemed to be, limited thereby and such other modifications or embodiments as may be suggested by the teachings herein are particularly reserved especially as they fall within the breadth and scope of the claims here appended.

What is claimed is:

1. A cook-off mitigation system, comprising:

a munition having an interior compartment, a nose end, and a tail end;

an explosive fill housed in said interior compartment; and an outgassing pad positioned inside said interior compartment of said munition, said outgassing pad having a shell with at least two sides that are diametrically-opposed to one another;

wherein said shell is configured to house an outgassing agent, wherein said outgassing agent is a powder and binder mix, wherein said powder is a blowing agent and zinc oxide mixture;

wherein said shell is positioned adjacent to said interior nose end of said munition;

wherein said outgassing pad is configured to expand as a wedge during a cook-off event.

2. The system according to claim 1, wherein at least one of said at least two sides is adjacent to said interior nose end of said munition, wherein the other of said at least two sides is adjacent to said explosive fill.

3. The system according to claim 1, wherein said shell has surface contours having a sigmoid shape.

4. The system according to claim 1, wherein said blowing agent is azodicarbonamide.

* * * * *